US008464486B1

(12) United States Patent
Elliott et al.

(10) Patent No.: US 8,464,486 B1
(45) Date of Patent: Jun. 18, 2013

(54) CONTOURED FLOOR PADS AND METHOD

(76) Inventors: Paul W. Elliott, Salem, IN (US); Steven M. Chase, Indianapolis, IN (US)

( * ) Notice: Subject to any disclaimer, the term of this patent is extended or adjusted under 35 U.S.C. 154(b) by 218 days.

(21) Appl. No.: 12/807,172

(22) Filed: Aug. 31, 2010

Related U.S. Application Data

(60) Provisional application No. 61/276,389, filed on Sep. 12, 2009.

(51) Int. Cl.
*E04F 15/22* (2006.01)

(52) U.S. Cl.
USPC ..... 52/403.1; 52/480

(58) Field of Classification Search
USPC ..... 52/480, 392, 403.1, 592.1, 482, 376; 248/632, 634
See application file for complete search history.

(56) References Cited

U.S. PATENT DOCUMENTS 2,862,255 A * 12/1958 Nelson ..... 52/403.1
3,107,377 A * 10/1963 Nathan ..... 14/73.1
3,499,255 A * 3/1970 Eberhart et al. ..... 52/263
4,238,914 A * 12/1980 Omholt ..... 52/309.3
4,682,459 A * 7/1987 Stephenson ..... 52/390
4,694,627 A * 9/1987 Omholt ..... 52/390
4,879,857 A * 11/1989 Peterson et al. ..... 52/403.1
4,890,434 A * 1/1990 Niese ..... 52/393
4,930,280 A * 6/1990 Abendroth ..... 52/403.1
4,945,697 A * 8/1990 Ott et al. ..... 52/403.1
5,016,413 A * 5/1991 Counihan ..... 52/391
5,277,010 A * 1/1994 Stephenson et al. ..... 52/403.1
5,299,401 A * 4/1994 Shelton ..... 52/393
5,303,526 A * 4/1994 Niese ..... 52/393
5,377,471 A * 1/1995 Niese ..... 52/482
5,388,380 A * 2/1995 Niese ..... 52/480
5,412,917 A * 5/1995 Shelton ..... 52/403.1
5,433,052 A * 7/1995 Niese ..... 52/403.1
5,465,546 A * 11/1995 Buse ..... 52/480
5,497,590 A * 3/1996 Counihan ..... 52/385
5,566,930 A * 10/1996 Niese ..... 267/153
5,609,000 A * 3/1997 Niese ..... 52/480
5,647,183 A * 7/1997 Counihan ..... 52/403.1
5,653,099 A * 8/1997 MacKenzie ..... 52/403.1
5,778,621 A * 7/1998 Randjelovic ..... 52/403.1
5,961,093 A * 10/1999 Jones et al. ..... 248/678
6,044,606 A * 4/2000 Hamar ..... 52/403.1
6,055,785 A * 5/2000 Counihan ..... 52/403.1
6,061,980 A * 5/2000 Poiencot ..... 52/177
6,115,981 A * 9/2000 Counihan ..... 52/403.1
6,122,873 A * 9/2000 Randjelovic ..... 52/403.1
6,141,931 A * 11/2000 Simmons ..... 52/480
6,158,185 A * 12/2000 Counihan ..... 52/403.1
RE37,615 E * 4/2002 Niese ..... 52/480
6,363,675 B1 * 4/2002 Shelton ..... 52/403.1
6,397,543 B1 * 6/2002 Hamar ..... 52/403.1
6,557,314 B2 * 5/2003 Shelton ..... 52/480
6,637,169 B2 * 10/2003 Niese et al. ..... 52/480

(Continued)

*Primary Examiner* — William Gilbert
*Assistant Examiner* — James Ference
(74) *Attorney, Agent, or Firm* — Gerald R. Black

(57) ABSTRACT

The apparatus and method for forming a tunable crumb rubber floor pad and flooring system using the pad. The method including the steps of; determining a pad design angle to provide a floor performance; cutting strips of pad material from a relatively thin sheet of recycled crumb rubber to form strips of pad material having two angled sides cut at the pad design angle, chopping the strips into pads wherein each pad has two angled walls and two straight walls. The pads are then stapled to a plywood subfloor.

20 Claims, 10 Drawing Sheets

U.S. PATENT DOCUMENTS

| | | | | |
|---|---|---|---|---|
| 6,688,065 | B2 * | 2/2004 | Chambers | 52/480 |
| 6,718,715 | B2 * | 4/2004 | Elliott | 52/403.1 |
| 6,742,312 | B2 * | 6/2004 | Valentine | 52/403.1 |
| 6,851,237 | B2 * | 2/2005 | Niese et al. | 52/480 |
| 6,918,215 | B2 * | 7/2005 | Smith | 52/177 |
| 6,931,808 | B2 * | 8/2005 | Hamar | 52/403.1 |
| 7,096,631 | B1 * | 8/2006 | Counihan | 52/403.1 |
| 7,121,052 | B2 * | 10/2006 | Niese et al. | 52/403.1 |
| 7,735,280 | B2 * | 6/2010 | Valentine | 52/403.1 |
| 7,832,165 | B2 * | 11/2010 | Randjelovic | 52/385 |
| 2002/0092255 | A1 * | 7/2002 | Niese et al. | 52/480 |
| 2002/0108340 | A1 * | 8/2002 | Elliott | 52/403.1 |
| 2002/0108341 | A1 * | 8/2002 | Hamar | 52/403.1 |
| 2002/0112429 | A1 * | 8/2002 | Niese et al. | 52/392 |
| 2002/0178675 | A1 * | 12/2002 | Valentine | 52/403.1 |
| 2002/0189184 | A1 * | 12/2002 | Shelton | 52/403.1 |
| 2003/0172608 | A1 * | 9/2003 | Chambers | 52/480 |
| 2004/0069924 | A1 * | 4/2004 | Lemieux et al. | 248/633 |
| 2005/0193670 | A1 * | 9/2005 | Niese et al. | 52/403.1 |
| 2005/0257474 | A1 * | 11/2005 | Randjelovic | 52/480 |
| 2006/0244187 | A1 * | 11/2006 | Downey | 267/140.3 |
| 2008/0104914 | A1 * | 5/2008 | Lemieux | 52/403.1 |
| 2009/0072457 | A1 * | 3/2009 | Downey | 267/140.3 |

* cited by examiner

© 2010 ASET SERVICES, INC.

© 2010 ASET SERVICES, INC.

© 2010 ASET SERVICES, INC.

© 2010 ASET SERVICES, INC.

© 2010 ASET SERVICES, INC.

© 2010 ASET SERVICES, INC.

© 2010 ASET SERVICES, INC.

© 2010 ASET SERVICES, INC.

© 2010 ASET SERVICES, INC.

© 2010 ASET SERVICES, INC.

CONTOURED FLOOR PADS AND METHOD

CROSS REFERENCES TO RELATED APPLICATIONS

Provisional Application for Patent No. 61/276,389 of Sep. 12, 2009 with the title "Floor Pad" which is hereby incorporated by reference. Applicants claim priority pursuant to 35 U.S.C. Par. 119(c).

COPYRIGHT NOTICE

A portion of the disclosure of this patent document contains material that is subject to copyright protection. The copyright owners have no objection to the facsimile reproduction of the patent disclosure by anyone of the patent disclosure as it appears in the Patent and Trademark Office patent files and records but otherwise reserve all copyrights whatsoever.

STATEMENT AS TO RIGHTS TO INVENTIONS MADE UNDER FEDERALLY SPONSORED RESEARCH AND DEVELOPMENT

Not applicable.

BACKGROUND OF THE INVENTION

1. Field of the Invention

This invention relates to a compressible pad for supporting a wood floor, such as, but not restricted to, a hardwood sports floor above a base.

2. Background Information

For many indoor athletic venues, particularly venues where basketball is a major sport, hardwood floors remain the playing surface of choice. Hardwood floors provide uniform performance characteristics over a relatively long period of time. Hardwood floors are esthetically pleasing, and properly designed and installed hardwood floors help to minimize wear and tear on the bodies of the athletes performing on the surface of such floors.

Typically, to minimize wear and tear, hardwood sports floors provide some amount of vertical "give", or deflection, which results from the use of resilient pads which support the floor above a base. In many cases the pads are arranged in parallel rows along the bottom surfaces of a sub-floor structure, and floorboards are secured to the top of the sub-floor. A typical resilient hardwood floor system of this type has been sold for a number of years, under the trademark PERMA-CUSHION. These resilient pads are used within a flooring system to provide cushioning and vibration control.

With this type of floor, because the sub-floor and the upper floorboards are supported in spaced relation above the base via the pads, there exists a certain amount of vertical clearance space between the under side of the sub-floor and the base, thereby allowing air circulation. This helps to minimize potential problems which may otherwise be caused by the intake or egress of moisture by the wooden floor components, either due to flooding or moisture resulting from humidity in the air.

The particular composition and structure of the pads helps to determine the overall vertical deflectability, or resiliency of the floor structure located above. That is, to provide the desired vertical deflection, prior hardwood floor pads have come in a number of different shapes and sizes. Often the pads include void spaces to accommodate some desired amount of deflection, with the void spaces opening either in the vertical direction or in the horizontal direction.

But, for many athletic venues, particularly in venues where the cost constraints may be greatest, the preferred hardwood floor may be a relatively simple structure of the type described above, with an upper layer of floorboards supported on a sub-floor, most likely parallel spaced rows of attachment members laid end to end, and supported above a base by a plurality of uniformly distributed pads. For these floors the pads must provide a desired amount of vertical spacing above the base and vertical deflectability for the upper floor surface when the floor is in use. Also, because the weight of the sub-floor and the floorboards supplies some amount of initial compression to the pads, i.e. when in a "static loaded" condition, the design, the shape and composition of the pads must take into account the degree of compression of the pad in the static loaded condition, and the further compressibility of the pad which is available when the pads are "loaded" due to additional force or weight applied to the floor above.

One commonly used pad for floors of this type includes spaced upper and lower pieces held apart by a plurality of parallel rows of vertical supports defining a plurality of parallel rows of rectangular-shaped horizontal passages between the upper and lower pieces. The rectangular-shaped passages within the pads provide some amount of void space to facilitate compression of the pads, to a degree determined by the material of the pad, the amount of loading to the floor, and the density and/or distribution of the pads used to support the floor. Typically, these pads are integrally molded, as by extrusion. This particular pad has proven well suitable for extended time in supporting hardwood floors in many athletic venues.

Nevertheless, as a result of testing the compressibility of these pads, particularly the restoring forces of these pads, i.e., the ability of the pad to reassume its original state, i.e. to decompress, to the static loaded condition, can be improved. For instance, with these pads, it has been experienced that in some cases the parallel longitudinal supports may buckle sideways after being subjected to excessive vertical loads, or loads over a long period of time. Moreover, because the upper layer of floorboards may expand and contract due to moisture intake and egress, as a result of humidity changes, and because the pads usually frictionally engage the base, even in a static state the pads may be subjected to and required to withstand some horizontal sheer forces. These sheer forces may promote, or accelerate, the undesired buckling of the supports. Once buckling occurs, the pads can eventually become transformed into incompressible masses.

This can significantly reduce the resiliency of the floor, or even make the resiliency negligible.

Traditional molded and extruded pads commit to a shape and then tailor their performance through manipulating material properties. These different pads, with different performance levels are traditionally identified through different color materials. The lack of geometric differences requires that the pads be different colors as one can not visually distinguish the difference between a hard and a soft pad.

One can not easily, quickly, or cheaply change the geometry, even slightly, of a molded or an extruded pad to tweak performance.

As will be seen from the subsequent description of the preferred embodiments of the present invention overcomes these and other shortcoming of existing floor pads in an economic and efficient manner.

SUMMARY OF THE INVENTION

The preferred embodiment of the present invention is a floor pad with at least one non-vertical edge, resulting in a shape that self adjusts its resiliency under a progressive load due to its shape. The geometric enhancement of at least one non-vertical edge allows the floor pad to have a reduced initial stiffness while allowing the stiffness to increase with increasing deflections. The at least one non-vertical edge permits the use of at least one staple to secure the floor pad to a wooden load distribution plate both as a convenience in pad placement as well as making a contribution to the structural performance of the resulting assembly of pads and load distribution plates.

DESCRIPTION OF THE PREFERRED EMBODIMENTS

Referring to FIGS. 1A through 1D, the preferred embodiment of the present invention, a floor pad 1 comprises a top 1*a*, a bottom, 1*b*, at least one shaped side, in this case a sloped side 1*c*, at least one staple location 1*d*, and straight cut ends 1*e*.

Referring to FIGS. 2A through 2D, an alternate embodiment of the present invention, an alternate floor pad 10 comprises an alternate embodiment top 10*a*, an alternate embodiment bottom 10*b*, at least one first sloped side 10*c*, at least one second sloped side 10*f*, and at least one staple location 10 *d*, and alternate embodiment ends 10*e*.

Figure 3A:
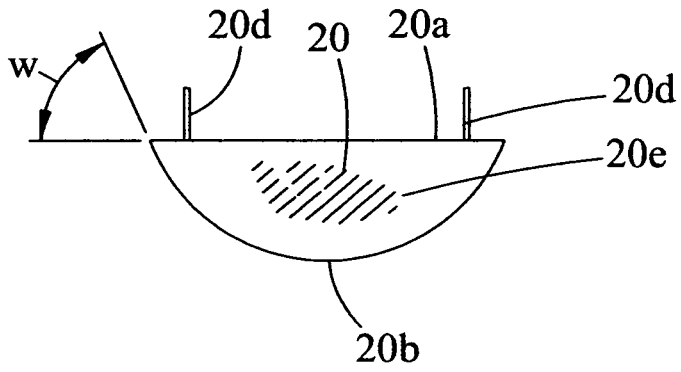
FIGS. 3A through 3D illustrate a second alternate embodiment of the present invention.
Figure 3B:
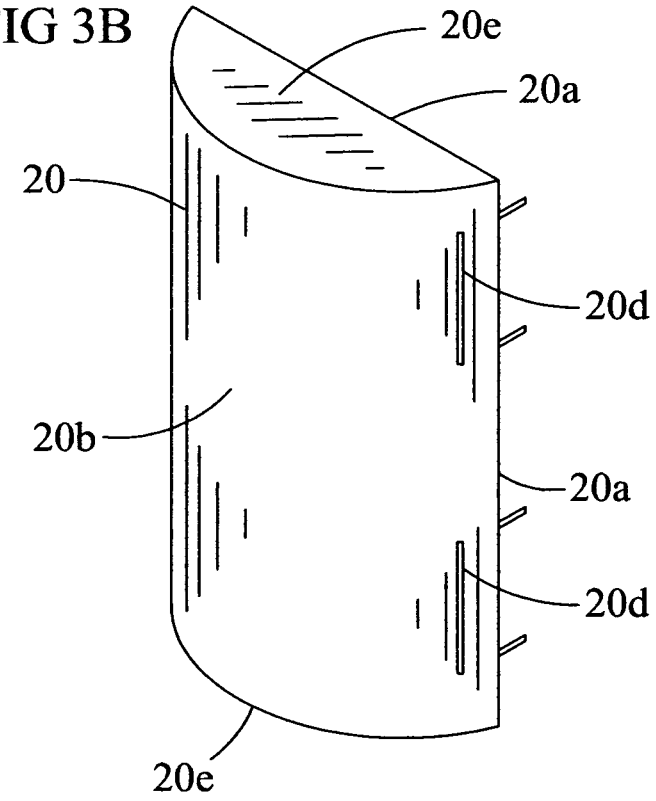
Figure 3C:
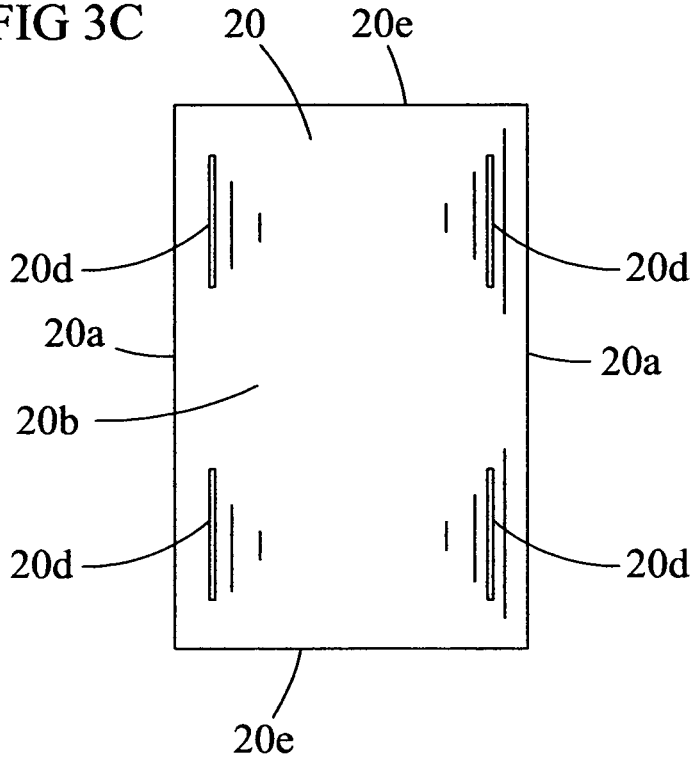
Figure 3D:
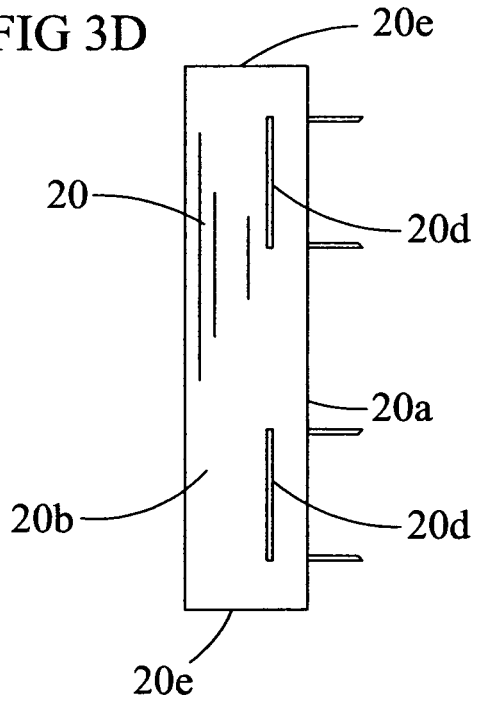

Referring to FIGS. 3A through 3D, a second alternate embodiment of the present invention, a second alternate floor pad 20 comprises a second alternate embodiment top 20*a*, a second alternate embodiment bottom 20*b*, and staple locations 20 *d*. FIG. 3A shows that an initial angle w can be the design angle for the curve. The smaller the angle W the smaller the initial load and the more quickly the load rises upon compression.

Figure 5:
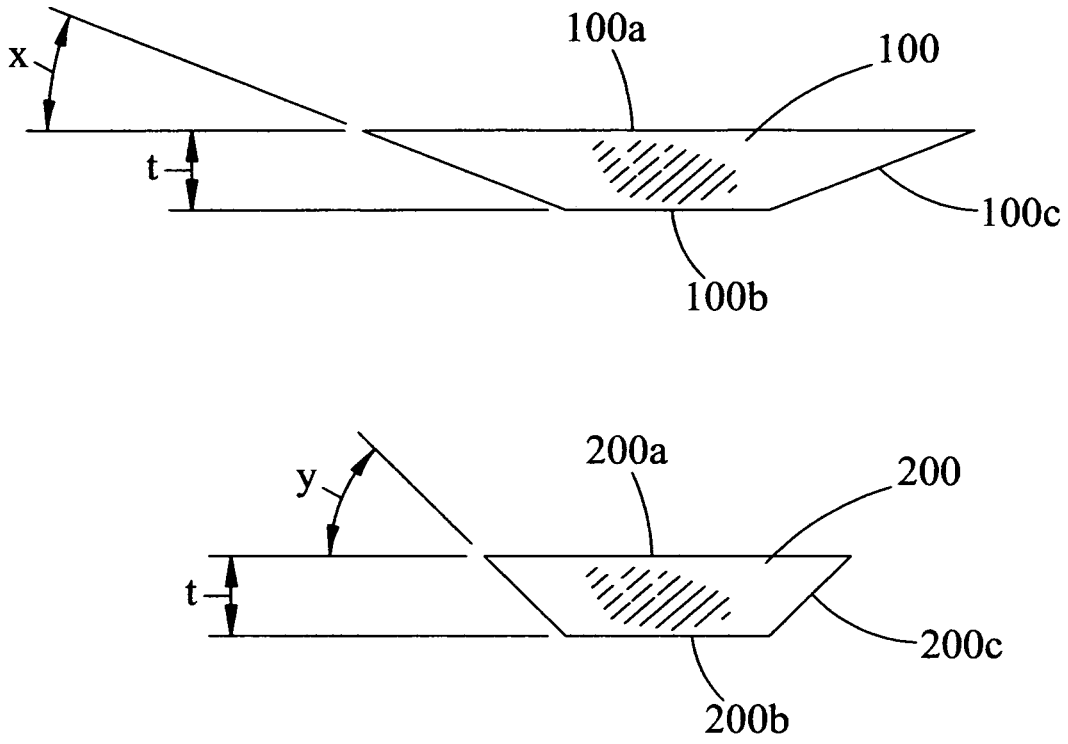
FIG. 5 shows a third and fourth alternate embodiment.

Based on shape alone the pad of 1A would start out soft and get stiffer as the pad is compressed. The closer the angle of 1C gets to become parallel to 1*b* the pad will be softer initially but will increase stiffness rapidly upon compression. FIG. 5 shows two pads 100 and 200 cut from the same thickness material t. Both pads 100, 200 have the same cross sectional area and so would take the same amount of material but pad 100 has a smaller initial surface contact area 100*b* and a larger base area 100*a*. So the pad 100 will start soft but rapidly increase in stiffness compared to pad 200 that has a steeper angle 200*c* which starts stiffer but increases in stiffness gradually. This allows a designer to design and tune a desired floor performance using a single crumb rubber sheet thickness and Dura meter.

Figure 1A:
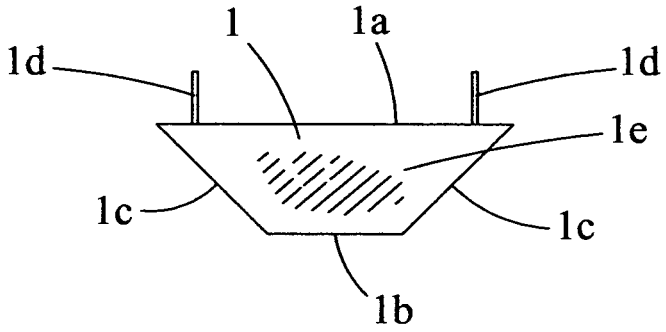
FIGS. 1A through 1D illustrate the preferred embodiment of the present invention, a floor pad.
Figure 1B:
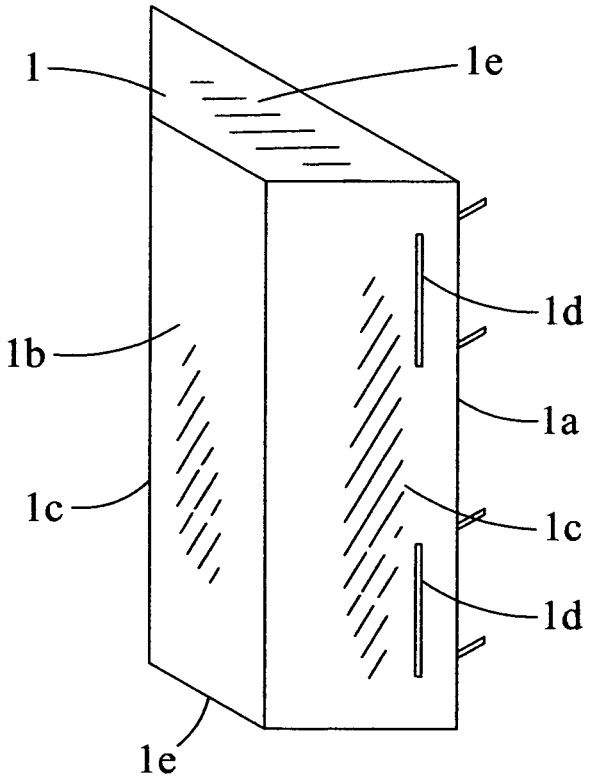
Figure 1C:
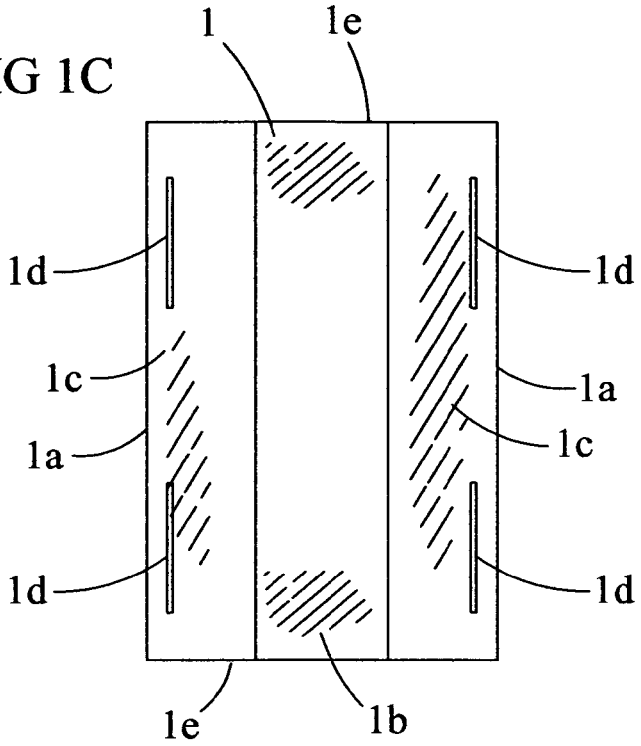
Figure 1D:
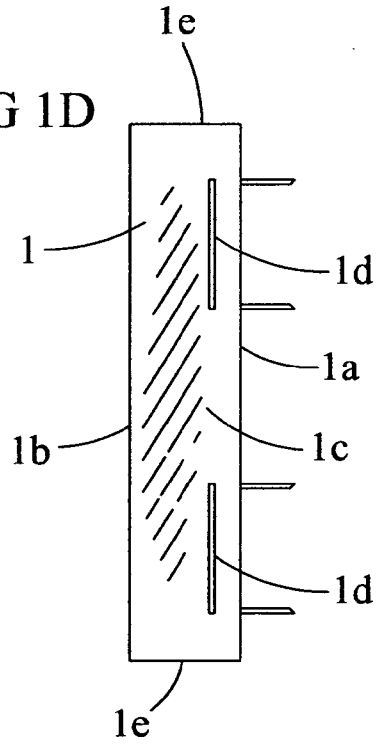
Figure 2A:
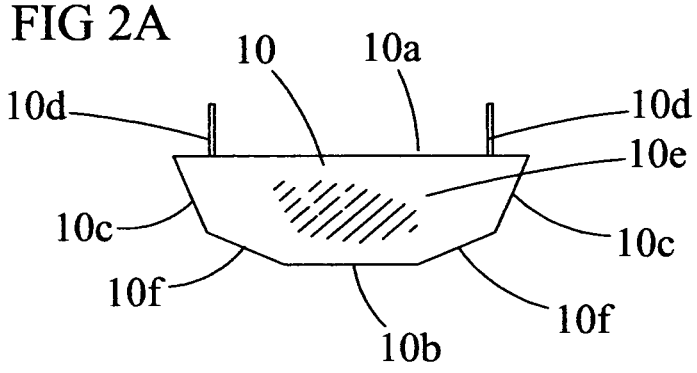
FIGS. 2A through 2D illustrate an alternate embodiment of the present invention.
Figure 2B:
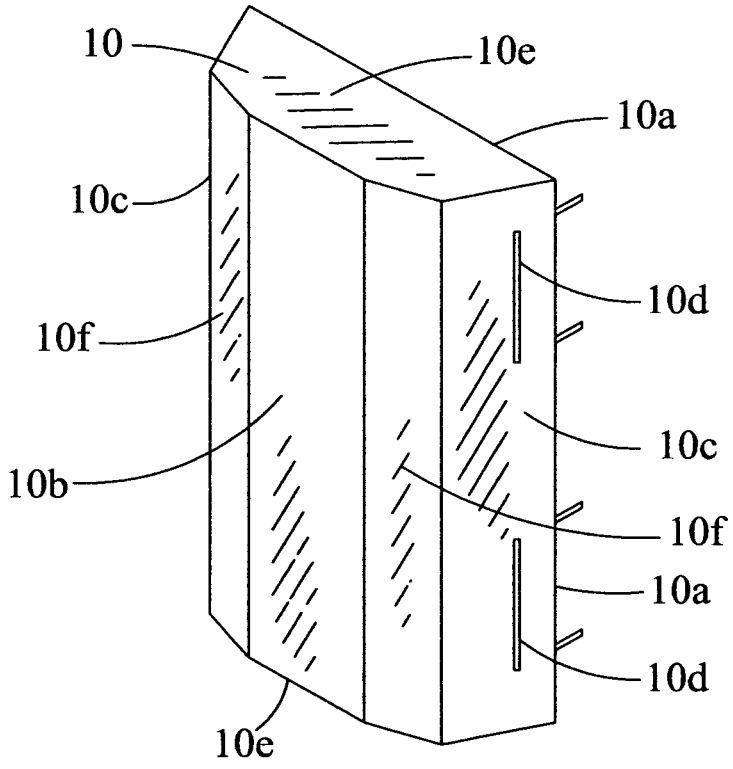
Figure 2C:
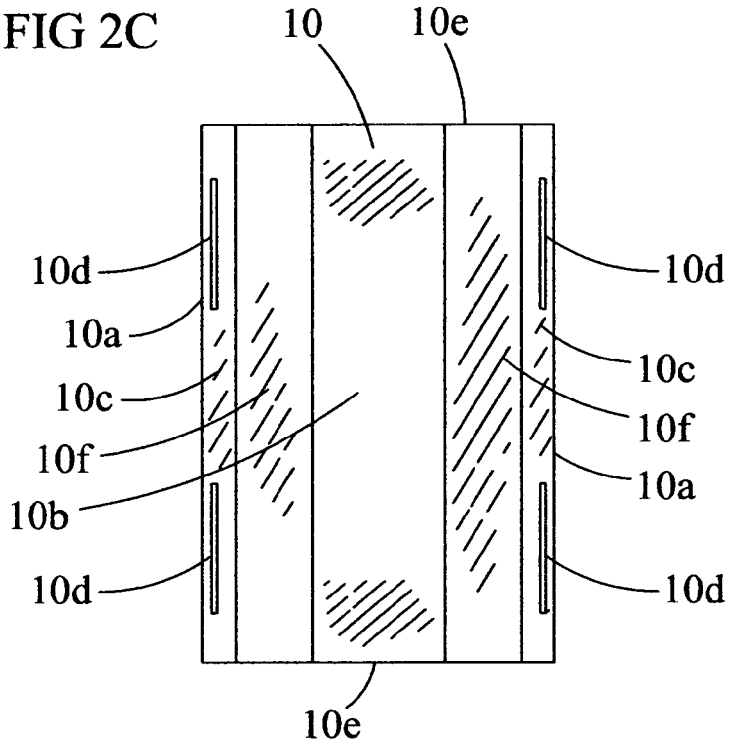
Figure 2D:
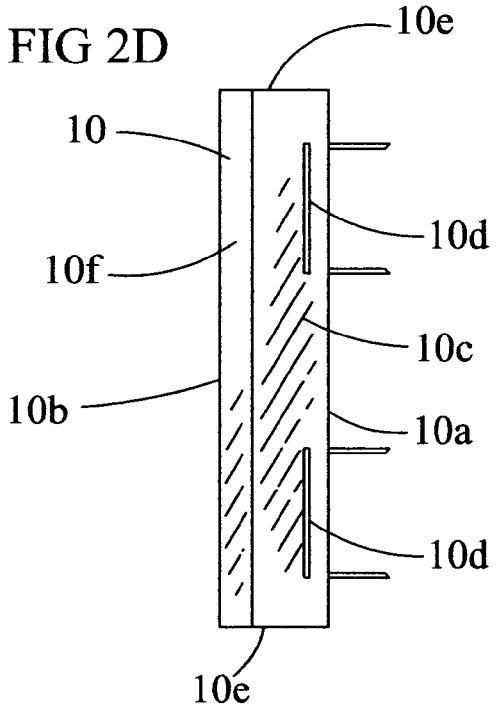
Figure 4A:
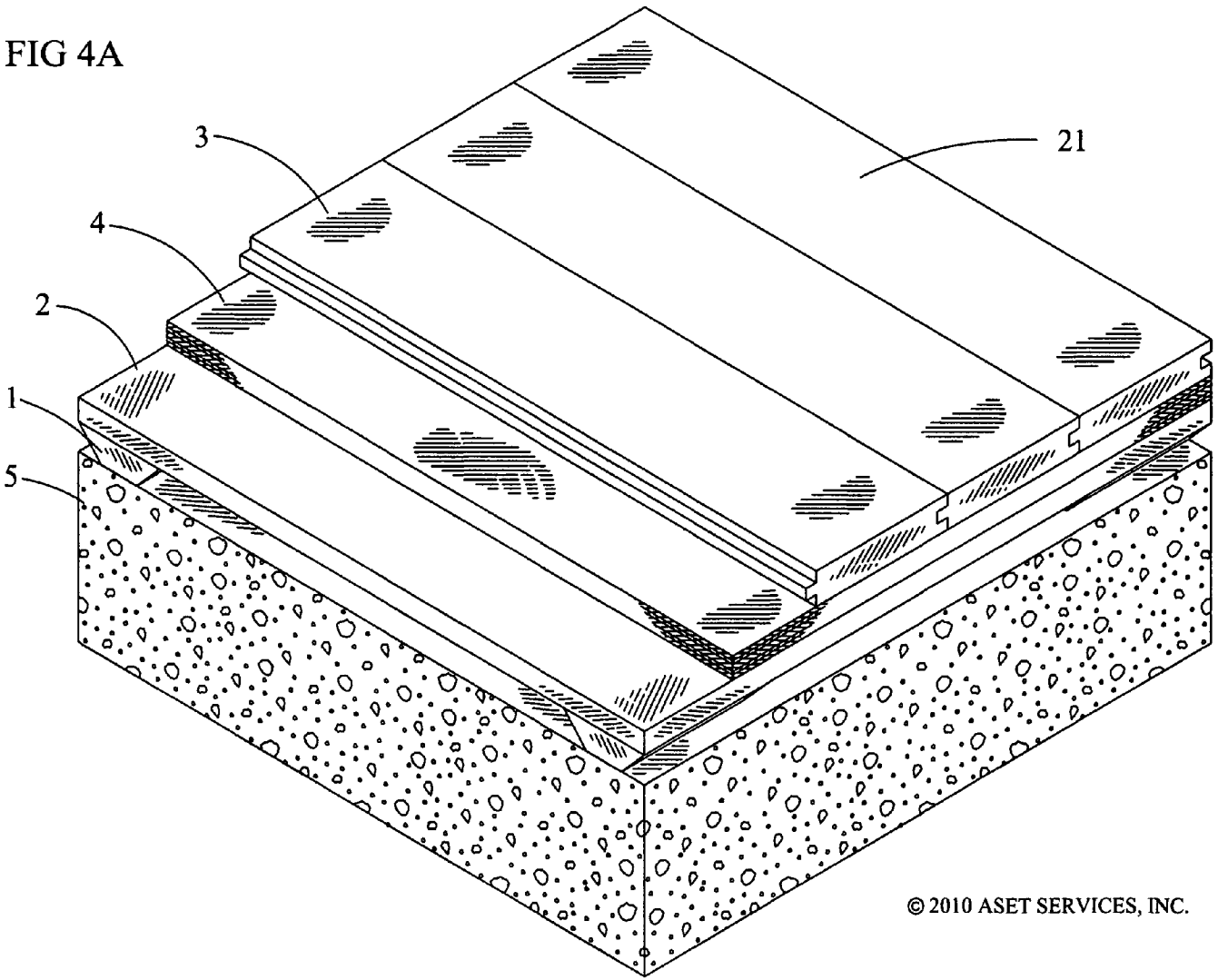
FIGS. 4A through 4C illustrate an installation of the preferred embodiment of the present invention.
Figure 4B:
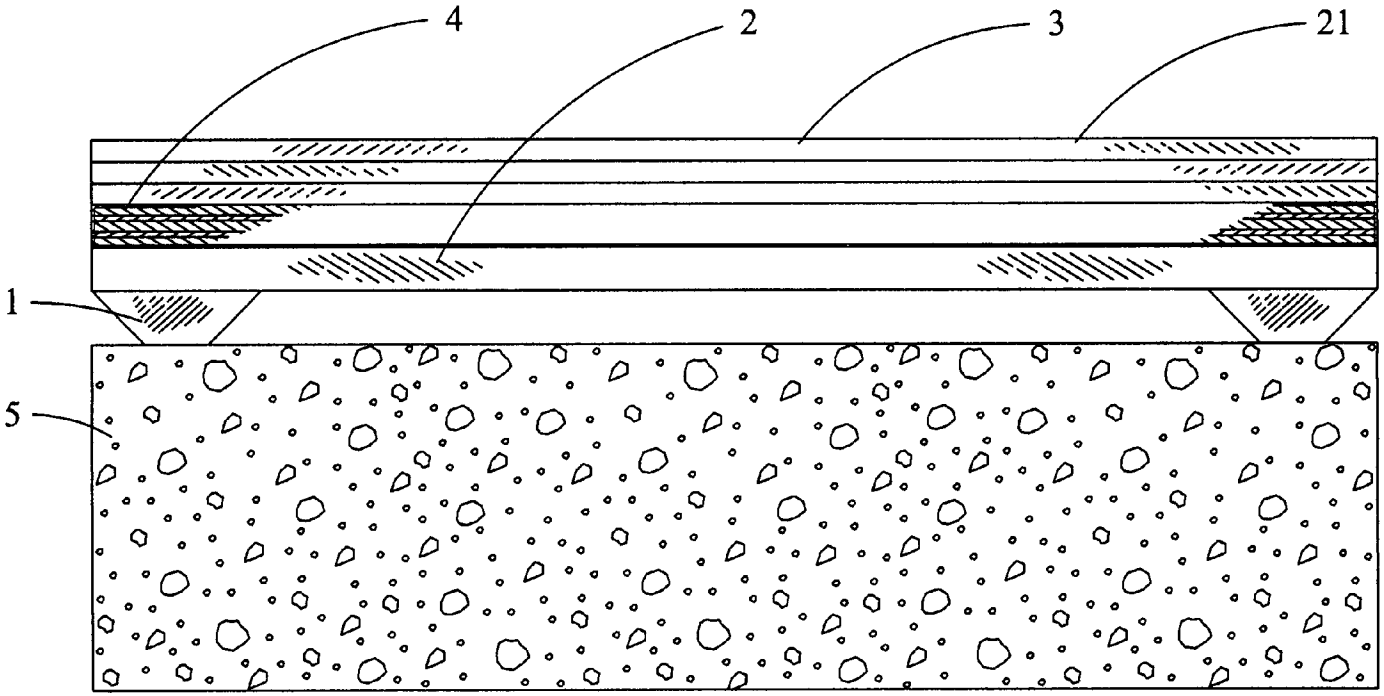
Figure 4C:
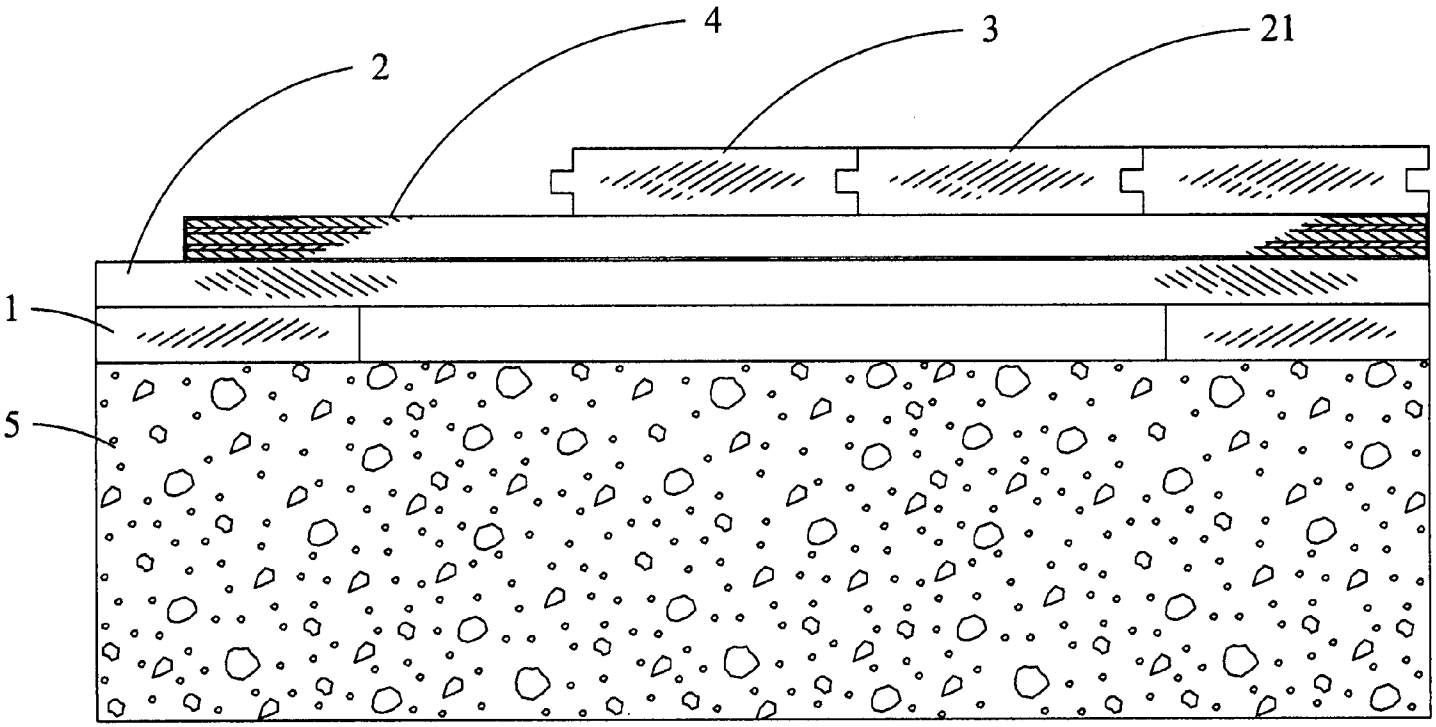

Referring to FIGS. 4A through 4C, a generic two layer floating pane, 1 sports surface 21 is shown incorporating the floor pad 1. The sports surface 21 comprises a first plywood load distribution plate 2, hardwood flooring 3, a second plywood load distribution plate 4, with the floor pad 1 affixed, such as with staples, to the second plywood load distribution plate 4 with the sports surface 21 rides on the floor pad 1 which rests on the concrete base 5. The staples 1*d* (Ref. FIG. 1C) serve to affix the floor pads 1 to the second plywood load distribution plate 2 as a construction convenience.

As opposed to traditional floor pads that have vertical edges on all of the perimeter, the pads 1, 10, and 20, inclusion of the respective sides 1*c*, 10*c* and 10*f*, and the second alternative embodiment top 20*a*, allows the pads 1, 10, and 20 to have greatly reduced initial stiffness while allowing the stiffness to increase with increasing deflections. This variable stiffening is unique. A vertical edge, i.e. non-sloped sides, relies only on the compressibility of the material to develop increasing stiffness. The shaped, eloped sides 1*c*, 10*f*, and the top 20*a* allow more material to contact the supporting base layer during compression, thus stiffness is changed both by the compressibility of the material and by engaging more of the material during compressibility. The resulting variable contact area allows one pad to support both the biomechanical load, and mildly industrial loads (man-lifts, chair carts as examples) without damage. Gradual stiffening is important to limit vertical deflections during athletic activity to provide a secure shoe-surface interface for an athlete.

The attached three pages of Appendix illustrate force deflection curves, with pad descriptions, and results provide examples of the variable stiffening mentioned above.

The pads 1 and 10 are unique in that their geometry allows a contoured pad to be produced from sheet goods derived from a 90% or greater content of recycled rubber crumb material, produced from crumbs of foam rubber held together with a binder forming a crumb rubber matrix. Sheets of crumb rubber material 4 mm to 20 mm thick can be cut into strips using a tool such as a bladed tool or a hot wire with a design angle edge and then the strips can be chopped into pads with two straight edges and two angled edges. Strips of closed cell or open cell foam rubber are also usable. The geometry allows the pads 1 and 10 to be manufactured from a machining process, as well as permits automated stapling. By use of the machining process, rapid and relatively inexpensive response to changing slope requirements, as compared to molding or extrusion processes is possible.

As opposed to manipulating material properties to attain performance characteristics, a fabricator can commit to one material, and through the aforementioned geometry, develop a family of pads that provides different force reduction levels. Conventional molded/extrusion materials, now used, have to be color coded for identification while the preferred embodiments of the present invention, using crumb rubber, or foam rubber, are visually distinguishable through particle side, porosity, and geometry.

Geometry based customization allows performance modifications to be made more easily, quickly, and with less inventory. In the most basic forms, such as floor pads 1 and 10, the geometry modifications would be modifying the respective slopes 1*c*, or 10*c* or 10*f*. In the more complicated form, such as floor pad 20, the top 20*a* can be modified by changing out a milling head.

The floor pad 1 has been tested under a floating panel system, providing force reduction and deflection levels required by international standards, found to control vibrations as outlined by DIN 18032-2. The control of vibrations and passing this German DIN standard is extremely difficult in this system. The floor pads 1, 10, and 20 offer these same force reductions and deflection control benefits to a wide variety of system types and construction.

The sloped sides 1*c* and 10*c* and 10*f* as well as the top 20*a* help deflect forces encountered in palletization, i.e. grouping pre-assembled units into a palletized bundle for shipment and during installation, as compared to the square edges of a traditional pad. Also, stapling the pads 1, 10, or 20 to a sleeper/sub-floor component 2 can be done with the staple in an initially non-load bearing area of the pads 1, 10, or 20 as compared to prior art pads which need to be stapled through the load bearing pad face. Controlling the depth of stapling, traditionally, has been tricky as if the depth is not sufficient, the stable doesn't hold, and if it is too much, the staple cuts through the traditional pad. With the preferred embodiments of the present invention, pads 1, 10, and 20, a wider crown staple is usable and the staple can be more easily set to a depth that optimizes holding strength while minimizing impact on performance.

The reduced contact areas of the pads 1, 10, and 20, provides reduced friction between the pads 1, 10, and 20 which are attached to, and move with, a sleeper/sub-floor 2 and concrete 5 (as compared to traditional square cut prior art pads). In a floating floor system, this reduces forces generated during expansion and contraction and allows the pads 1, 10, and 20 to resist rolling or becoming dislocated from the sleeper/sub-floor 2. The bottoms 1*b*, 10*b*, and 20*b* allow the pads 1, 10, and 20 to still provide loading resistance similar to a traditional pad with all right angles.

The key principal of the preferred embodiments of the present invention is that the top and bottom faces are not the same surface area and that the amount of material in contact with the subfloor 2 and base 5 increases with increased load.

The above mentioned concepts apply to any variable width pad made from a crumb rubber material. Most apply to many other elastomeric and cross linked plastic materials. The shapes could be trapezoidal, cylindrical, or polygon. It could be elliptical or hyperbolic, just wider on the top and narrower on the bottom. These other shapes offer potentially different tuning features of a pad of this nature while still keeping the principal that the top and bottom faces are not the same surface area.

Traditional pads designed to meet DIN standards require several modifications in order to meet the German standard DIN 18032-2 which is common in the United States. Few pads exist today which provide certification under DIN 18032-2 (1991) under a floating panel system. The preferred embodiments of the present invention, floor pads 1, 10, and 20 not only achieves that performance level, but does so with 90% recycled material.

In use a designer will have specifications for a given floor use. The designer can first determine a shape for the pad. With the pad shown in FIGS. 1 and 5 a designer would select an angle 1*c*, 100*c*, 200*c*, base contact area 1*a*, 100*a*, 200*a* and the initial contact area l,b, 100*b*, 200*b*. Once designed strips of pads can be cut from a sheet of material having a thickness t. The strips are then chopped to length to form pads. The pads can then be stapled through locations 1D to the subfloor 2 and the subfloor 2 is laid in contact with a concrete surface 5 and the remainder of the floor can be assembled as shown in FIG. 4.

The variable cross-section shape allows un-molded and un-moldable materials to achieve basic variable loading curves needed for optimal flooring performance (starting softer and getting stiffer gradually). This opens the door to tuning pad performance for the crumb rubber matrix pads, but also to closed cell and open cell foams produced in sheet goods shapes.

The current design focuses on a homogenous material, but there are applications where the material could be formed from multiple layers (2, 3, or more) where each layer provides different compression and damping properties.

Although the description above contains many specificities, these should not be construed as limiting the scope of the invention, but as merely providing illustrations of some of the presently preferred embodiments of this invention.

As will be obvious to those skilled in the art that modifications may be made to the embodiments described above without departing from the scope of the present invention. Thus the scope of the invention should be determined by the appended claims in the formal application and their legal equivalents, rather than by the examples given.

We claim:

1. A floor pad system for tuning a desired floor performance, said floor pad system comprising:

an upper floor surface having a base layer;

a plurality of floor pads made of a floor pad material supporting said upper floor surface, said plurality of floor pads being affixed to said upper floor surface by a plurality of staples, a first floor pad of said plurality of floor pads having an upper surface with an upper floor pad contact area that supports said upper floor surface, said first floor pad having a lower surface with a lower floor pad contact area, said lower floor pad contact area abutting a subfloor, said upper floor pad contact area of said first floor pad being different than said lower floor pad contact area of said first floor pad, said floor pad material is a crumb rubber matrix pad cut from a sheet of recycled crumb rubber; and a second floor pad of said plurality of floor pads having an upper surface with an upper floor pad contact area that supports said upper floor surface, said second floor pad having a lower surface with a lower floor pad contact area, said lower floor pad contact area abutting said subfloor, said upper floor pad contact area of said second floor pad being different than said lower floor pad contact area of said second floor pad; and whereby said first floor pad is attached to said upper floor pad surface by a first and a second staple of said plurality of staples, said first and second staples each having a pair of staple ends, said pair of staple ends of said first staple extending through said first floor pad and into said base layer of said upper floor surface, said pair of staple ends of said second staple extending through said first floor pad and into said base layer of said upper floor surface;

whereby said second floor pad is attached to said upper floor pad surface by a third and a fourth staple, said third and fourth staples each having a pair of staple ends, said pair of staple ends of said third staple extending through said second floor pad and into said base layer of said upper floor surface, said pair of staple ends of said third and fourth staples extending through said second floor pad and into said base layer of said upper floor surface; and whereby said upper floor pad contact area and said lower floor pad contact area of said first and second floor pads enable contouring stiffness of said floor pad system to be tuned to support a variety of loads upon said upper floor surface.

2. The floor pad system of claim 1, wherein said first and second floor pads are a recycled crumb rubber.

3. The floor pad system of claim 1, wherein said floor pad material is a crumb rubber matrix pad cut from a sheet of recycled crumb rubber matrix.

4. The floor pad system of claim 1, wherein said first floor pad has an angled sidewall, said upper floor pad contact area of said first floor pad being greater than said lower floor pad contact area of said first floor pad.

5. The floor pad system of claim 4, wherein said angled sidewall enables more of said floor pad material to contact said base layer during compression.

6. The floor pad system of claim 1, wherein said upper floor surface is a sports floor for athletic events.

7. The floor pad system of claim 1, wherein said floor pad has reduced initial stiffness and increased variable stiffness with increasing deflection.

8. A floor pad system for tuning a desired floor performance, said floor pad system comprising:

an upper floor surface having a base layer;

a plurality of floor pads made of a floor pad material supporting said upper floor surface, said plurality of floor pads being affixed to said upper floor surface by a plurality of staples, a first floor pad of said plurality of floor pads having an upper surface with an upper floor pad contact area that supports said upper floor surface, said first floor pad having a lower surface with a lower floor pad contact area, said lower floor pad contact area abutting a subfloor, said upper floor pad contact area of said first floor pad being different than said lower floor pad contact area of said first floor pad, said floor pad material being a crumb rubber matrix pad cut from a sheet of recycled crumb rubber, said first floor pad having a first sloped side surface and a second sloped side surface; and a second floor pad of said plurality of floor pads having an upper surface with an upper floor pad contact area that supports said upper floor surface, said second floor pad having a lower surface with a lower floor pad contact area, said lower floor pad contact area abutting said subfloor, said upper floor pad contact area of said second floor pad being different than said lower floor pad contact area of said second floor pad; and whereby said first floor pad is attached to said upper floor pad surface by a first and a second staple of said plurality of staples, said first and second staples each having a pair of staple ends, said first and second staple ends of said first staple extending through said first sloped side surface and said upper floor surface, said first and second staple ends of said second staple extending through said second sloped side surface and said upper floor surface;

whereby said sloped edges of said first and said second floor pads are attached to said load distribution plate by said first and second staples, said first and second staples contributing to the structural performance of the floor pad system and said load distribution plate; and whereby said first and second floor pads have reduced initial stiffness and increased variable stiffness with increasing deflection.

9. The floor pad system of claim 8, wherein said floor pad material is a crumb rubber matrix.

10. The floor pad system of claim 8, wherein said floor pad material is a crumb rubber matrix pad cut from a sheet of recycled crumb rubber matrix.

11. The floor pad system of claim 8, wherein one of said floor pads has an angled sidewall, said upper floor pad contact area of said one of said first floor pads being greater than said lower floor pad contact area of said one of said first floor pads.

12. The floor pad system of claim 11, wherein said angled sidewall enables more of said floor pad material to contact said base layer during compression.

13. The floor pad system of claim 8, wherein said upper floor surface is a hardwood sports floor for athletic events.

14. The floor pad system of claim 8, wherein said upper floor pad contact area of said first and second floor pads and said lower floor pad contact area of said first and second floor pads enable contouring stiffness of said floor pad system to be tuned throughout to support a variety of loads upon said upper floor surface.

15. A floor pad system for tuning a desired floor performance, said floor pad system comprising:

an upper floor surface having a base layer, said base layer including a load distribution plate; and a plurality of floor pads made of a floor pad material supporting said upper floor surface, said plurality of floor pads being affixed to said upper floor surface by a plurality of staples, a first floor pad of said plurality of floor pads having an upper surface with an upper floor pad contact area that supports said upper floor surface, said first floor pad having a lower surface with a lower floor pad contact area, said lower floor pad contact area abutting a subfloor, said upper floor pad contact area of said first floor pad being different than said lower floor pad contact area of said first floor pad, said floor pad material is a crumb rubber matrix pad cut from a sheet of recycled crumb rubber; and a second floor pad of said plurality of floor pads having an upper surface with an upper floor pad contact area that supports said upper floor surface, said second floor pad having a lower surface with a lower floor pad contact area, said lower floor pad contact area abutting said subfloor, said upper floor pad contact area of said second pad being different than said lower floor pad contact area of said second floor pad; and whereby said first floor pad has angled sidewalls, said upper floor pad contact area of said first floor pad being greater than said lower floor pad contact area of said first floor pad, said upper floor pad area of said first floor pad abutting said base layer of said upper floor surface during compression of said first floor pad, said angled sidewalls enabling more of said floor pad material to contact said base layer during compression of said first floor pad; and whereby said angled sidewalls are attached to said load distribution plate by a first and a second staple of said plurality of staples, said first and second staples contributing to the structural performance of the floor pad system and said load distribution plate.

16. The floor pad system of claim 15, wherein said floor pad material is a crumb rubber matrix.

17. The floor pad system of claim 15, wherein said floor pad material is a crumb rubber matrix pad cut from a sheet of recycled crumb rubber matrix.

18. The floor pad system of claim 15, wherein said upper floor pad contact area of said first and second floor pads and said lower floor pad contact area of said first and second floor pads enable contouring stiffness of said floor pad system to be tuned to support a variety of loads upon said upper floor surface.

19. The floor pad system of claim 15, wherein said floor pad has reduced initial stiffness and increased variable stiffness with increasing deflection.

20. The floor pad system of claim 15, wherein said upper floor surface is a hardwood sports floor for athletic events.

* * * * *